United States Patent [19]

Rapshys

[11] 4,099,184

[45] Jul. 4, 1978

[54] DIRECTIVE ANTENNA WITH REFLECTORS AND DIRECTORS

[75] Inventor: William Rapshys, Palatine, Ill.

[73] Assignee: Motorola, Inc., Schaumburg, Ill.

[21] Appl. No.: 745,887

[22] Filed: Nov. 29, 1976

[51] Int. Cl.[2] ..... H01Z 21/12

[52] U.S. Cl. ..... 343/875; 343/891; 343/854

[58] Field of Search ..... 343/876, 875, 874, 886, 343/884, 890, 891, 854

[56] References Cited

U.S. PATENT DOCUMENTS

| | | | |
|---|---|---|---|
| 3,229,297 | 1/1966 | Bell et al. | 343/874 |
| 3,334,348 | 4/1967 | Alfano, Jr. | 343/876 |
| 3,623,109 | 11/1971 | Neumann | 343/876 |

*Primary Examiner*—Alfred E. Smith
*Assistant Examiner*—David K. Moore
*Attorney, Agent, or Firm*—James P. Hamley; James W. Gillman

[57] ABSTRACT

An antenna system of the type wherein the radiating pattern may be controlled to direct the radiation of a signal in a selected direction. The system includes a plurality of radiating elements which are affixed to a coplanar in planes which are equiangular from each other. In response to a selected direction of radiation, control circuitry applies the signal to the coplanar antenna elements which are in a plane perpendicular to the selected radiating direction. Further, the control circuitry varies the electrical length of the remaining elements such that some act to direct, and other reflect the radiated signal.

14 Claims, 3 Drawing Figures

Fig. 1
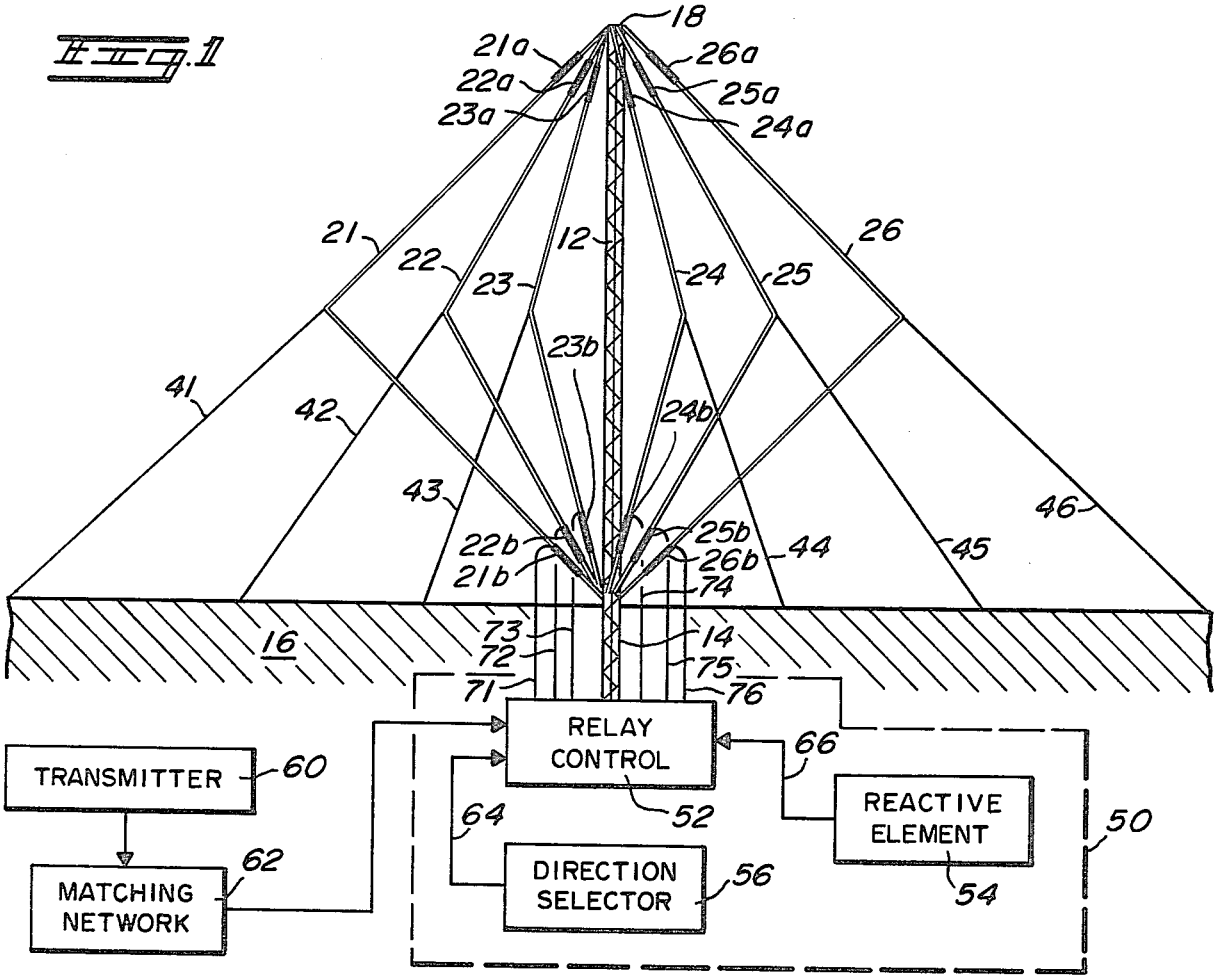
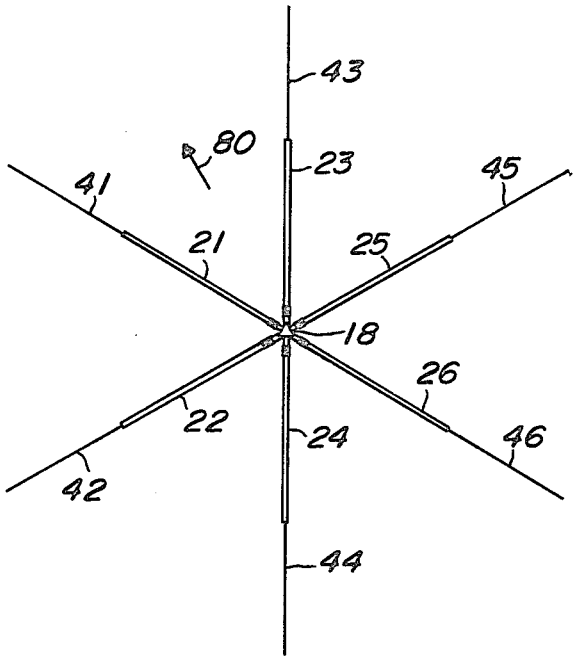
Fig. 2

DIRECTIVE ANTENNA WITH REFLECTORS AND DIRECTORS

BACKGROUND OF THE INVENTION

The present invention pertains to the radio frequency propagation art and, more particularly, to a directive antenna system for radio frequency signals.

Directive antenna systems are well known, especially in the high frequency communication art. There, it has been found that antenna systems may be arranged such that the radiation pattern from the antenna array may be made to beam in a selected direction.

A common form for such directive antenna systems is the Yagi array. In the Yagi array the signal to be transmitted is fed to a vertical antenna which has a length selected to optimally radiate those signals at the frequency of the signal to be transmitted. Thus, the antenna may be either $\frac{1}{4}$ or $\frac{1}{2}$ the wave length of the transmitted signal. Placed about the central vertical antenna are a series of parasitic elements which are arranged to either direct or reflect the signal radiated from the central antenna. A directive element is generally comprised of a vertically standing antenna element which has an electrical length less than $\frac{1}{2}$ wavelength of the signal being transmitted. A reflective antenna element is one having an electrical length greater than $\frac{1}{2}$ the wavelength of the signal to be transmitted. The electrical length of an antenna element may be varied by either coupling a reactive component to the element, or by physically changing the length of the element.

A primary problem with prior art parasitic type antenna arrays is that they require a plurality of vertically standing towers, which, in toto, cover a substantial land surface area. In addition, since a means must be provided to vary the electrical length of each tower, conventional directive antenna arrays have utilized a large "spiderweb" of intercoupling cabling. Moreover, conventional directive antenna arrays have required seven independently standing elements to accomplish the desired beaming, with each element being electrically insulated from ground, thus requiring an intricate grounding system. These requirements have resulted in expensive and costly antenna support structures.

SUMMARY OF THE INVENTION

It is an object of this invention, therefore, to provide an improved directive antenna system which requires a single supporting structure.

It is a further object of the invention to provide the above described antenna system which requires a minimum of intercoupling cabling.

A further object of the invention is to provide the above described improved antenna system which requires only minimal grounding.

An additional object of this invention is to provide the above described improved antenna system wherein the central supporting structure may be electrically grounded.

Briefly, according to the invention, the directive antenna system, which is operative to radiate a signal in a selected direction, comprises a vertically standing support means, a plurality of antenna elements, and suspension means which suspend the elements from the support means in a predetermined spaced relationship such that each element is electrically insulated from the remaining elements and from the support means. A selector means is provided which allows selection of the desired radiation direction. In response to the setting of the selector means, a control means performs three functions. Firstly, it applies the signal to be radiated to a predetermined pair of the antenna elements and adjusts the electrical length of the elements to optimally radiate the signal. Secondly, it varies the electrical length of predetermined antenna elements such that they reflect the radiated signal. Finally, the control means varies the electrical length of predetermined antenna elements to direct the signal.

The supporting means may be comprised of a vertically standing metallic tower which may be electrically grounded at its anchored portion. Moreover, the suspension means used to suspend the antenna elements from the vertically standing tower may be arranged such that the ends of the antenna elements are affixed to both the anchored end, and the vertical extent, or tip of the tower, whereby intercoupling cabling to the antenna system is minimized.

BRIEF DESCRIPTION OF THE DRAWINGS

FIG. 1 is a composite diagram showing a side view of the inventive antenna array system, and a schematic diagram showing in block diagram form the electrical components used to drive the array;

FIG. 2 is a top view of the antenna array shown in FIG. 1; and

DETAILED DESCRIPTION OF THE PREFERRED EMBODIMENT OF THE INVENTION

Figure 3:
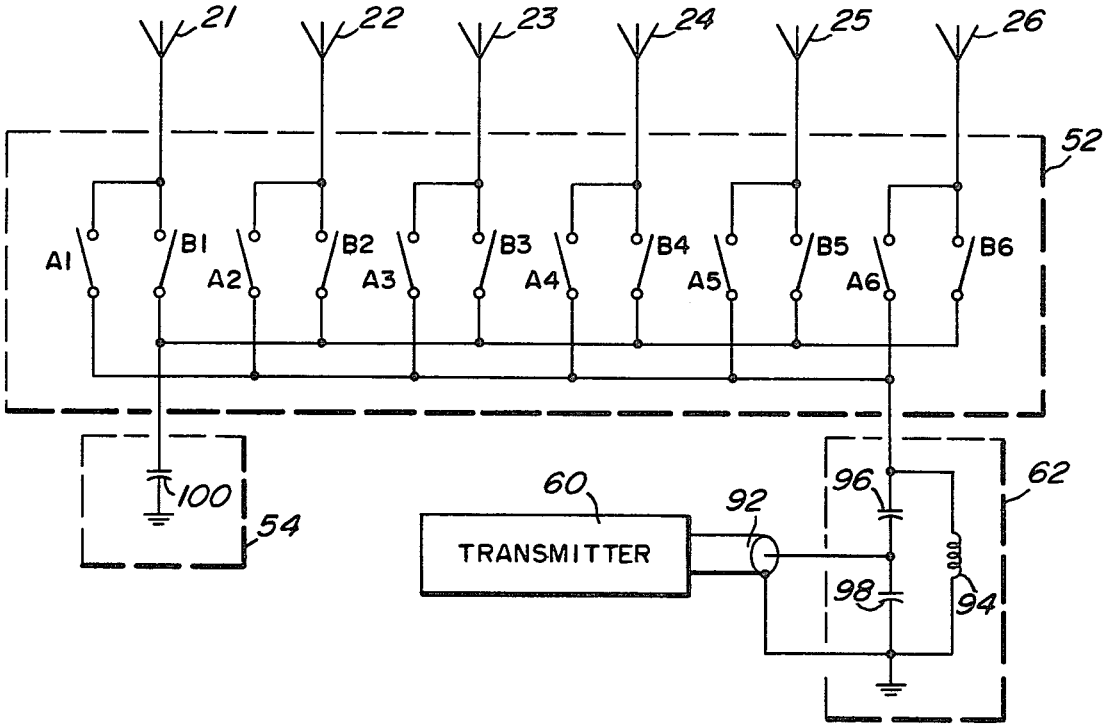
FIG. 3 is a detailed schematic diagram of the control circuitry suitable for driving the antenna array.

FIG. 1 shows a side view of the antenna array which is comprised of a vertically standing metallic tower 12. The tower is anchored, and grounded at its base portion 14 to earth 16. The tower 12 is shown supporting six antenna elements 21–26. The antenna elements 21–26 are affixed via a set of first insulators **21*a*–26*a* at one end to the vertically extending tip portion 18 of the tower 12 and are affixed via a second set of insulators 21*b*–26*b* to the base portion 14 of the tower 12. A series of guys 41–46 are affixed to the midpoint of the antenna elements 21–26 to thereby perform two functions. First, the guys 41–46 serve to guy each antenna element away from the tower 12. Also, the guys 41–46 are arranged to locate each antenna element in a predetermined spaced relationship with respect to the other antenna elements. It should also be observed that both the antenna elements 21–26 and the guys 41–46 cooperate to guy the tower structure 12**.

The spaced relationship of the antenna elements is better understood with reference to FIG. 2, which illustrates a view from above the antenna array looking down on the tower tip 18, the antenna elements 21–26 and the guy wires 41–46. Here it is seen that each antenna element, such as antenna element 21, and its pair on the other side of the tower 12, such as antenna element 26, are coplanar in a vertical plane which extends through the tower 12. Thus, antenna elements 23, 24 are coplanar in a vertical plane, as are antenna elements 22, 25. In the present embodiment of the invention, these vertical planes are equiangularly spaced such that the spacing between adjoining planes is 60°. It should be understood that in an alternate construction of the antenna a greater or lesser number of antenna elements may be used without departing from the spirit and scope of the invention.

Referring again to FIG. 1, the length of each antenna element 21–26 is designed to be slightly less than ½ wavelength of the signal to be transmitted, thus providing optimal signal radiation.

The antenna elements are controlled by a control system 50 which is comprised of a relay control 52, containing a plurality of relays (shown in FIG. 3), a reactive element 54 and a direction selector 56. Feeding to the control system 50 is a transmitter 60 which supplies the signal to be radiated over the antenna array. This signal is passed to the relay control 52 through a matching network 62. The direction selector may be comprised of a manually actuated, or automatically actuated switch which is selectively set to control the direction of radiation of the antenna array. The direction selector connects via a line 64 to the relay control 52. The relay control 52 couples via a series of cables 71–76 to each one of the antenna elements 21–26. The reactive element 54 couples via a line 66 to the relay control 52. The relay control 52 responds to the directional selector to activate selective ones of its relays in a manner described more thoroughly herein below.

ANTENNA SYSTEM OPERATION

Once a desired direction of antenna radiation has been selected via the direction selector 56, the control system 50 responds as follows. The transmitter 60 signal is routed in phase to that coplanar antenna element pair whose plane is perpendicular to the desired direction of radiation. Referring to FIG. 2, if the desired direction of radiation is as shown by the arrow 80, then the transmitter 60 signal is fed, through the matching network 62 and predetermined relays in the relay control 52, in phase to both antenna elements 22 and 25. The matching network 62 tunes the transmitter to the antenna elements, thus maximizing radiated power. In effect, matching network 62 causes the effective electrical length of the driven antenna elements appear to be one half the wavelength of the signal to be transmitted.

Further, the electrical length of those antenna elements which extend from the transmitter fed activated antenna pair in the direction of the desired radiation is left unchanged by the control system 50 such that they have an electrical length less than ½ wavelength of the signal being transmitted. For example, where the direction of desired radiation is given by arrow 80, the physical and electrical length of antenna elements 21, 23 would be unchanged by the control system 50 thus causing them to act as directors.

Finally, the electrical length of those antenna elements which extend from the coplanar transmitter fed antenna pair in a direction away from the desired antenna radiation direction is varied to be greater then ½ a wavelength, such that these elements act as reflectors. Increasing the effective electrical length of the antenna elements to be greater than ½ wavelength is acomplished via the reactive element 54 which couples a predetermined reactance to the selected antenna elements through the relay control 52. Thus, for the above example where the desired direction of radiation is shown by arrow 80, the reactive element 54 would couple a reactance to both antenna elements 24 and 26, thereby suitably increasing their electrical length.

FIG. 3 is a detailed schematic diagram of a preferred construction of the inventive directive antenna system. Each antenna element 21–26 is illustrated connected to pairs of relays $A_1$, $B_1$ – $A_6$, $B_6$, respectively, contained within the relay control 52. Circuitry which is not shown, but which would be obvious to anyone of ordinary skill in the art, is responsive to the status of the direction selector (shown in FIG. 1) to activate selective relays, thereby closng the corresponding relay contacts.

The transmitter 60 feeds through a coax cable 92 to the matching circuit 62. Matching circuit 62 is comprised of an inductor 94 which is in shunt with series coupled capacitors 96 and 98. The center conductor of the coax cable 92 couples to the common connection of the capacitors 96, 98 while the ground connection of the coax connects to the common connection of inductor 94 and capacitor 98, which, in turn, is grounded. The output from the matching network 62 is taken at the common connection of inductor 94 and capacitor 96, and is, in turn, applied to one contact of the first relay group $A_1$ – $A_6$. As mentioned herein above, the electrical length of the antenna elements 21–26 is selected to be slightly less than ½ wavelength at the frequency to be transmitted. Thus, to provide optimal coupling from the transmitter 60 to the antenna elements 21–26, the conventionally designed matching element 62 is employed. The effect of this matching network is to adjust the electrical length of the driven antenna elements such that they appear to have an electrical length of ½ wavelength as seen by the transmitter 60 and to transform the radiation resistance of the driven antenna elements to that of the coax cable 92.

One contact of the second group of relays $B_1$ – $B_6$ is connected to a reactive element 54, which in this preferred embodiment of the invention is comprised of a capacitor 100 series connected to ground potential. The effect of the capacitor 100 being coupled through ones of the second groups of relays $B_1$ – $B_6$ is to effectively increase the electrical length of the antenna elements whereby their length is greater than ½ wavelength of the signal being transmitted. Thus, they act as reflectors.

In operation, the setting of the direction selector to a given value causes selected relays of the first group $A_1$ – $A_6$ to close, whereby the transmitter signal is fed via the matching network 62 to a predetermined pair of the antenna elements. Those elements which are to act as reflectors are coupled via the corresponding ones of the second group of relays $B_1$ – $B_6$ to the reactive element 54 capacitor 100. Finally, those antenna elements which are to act as directors are left unconnected via the first and second groups of relays whereby their effective electrical length is maintained at less than ½ wavelength.

Referring again to FIG. 1, it has been found that a fully operative directive antenna system according to the invention for operation at 3.8 megahertz has the following dimensions. The tower is 100 feet high, and the length of each antenna element is approximately 120 feet. The guy wires support the antenna elements at their midpoint, whereby each element forms a 90° angle with itself. With these dimensions, degradation of the radiated signal due to ground currents in the tower have been found to be negligible, since the resonant frequency of the tower is significantly removed from the operating frequency of the antenna array.

In addition, it should be pointed out that the described antenna array uses elements having an electrical length of approximately ½ wavelength. Thus, as opposed to antennas employing elements having a length of ¼ wavelength, the inventive array is fully operative in applications wherein a solid ground plane is not available.

Thus, by the foregoing description, it should be understood that the preferred embodiment of the invention is capable of directing a radiation pattern in any one of six general directions. It should be understood, however, that a different number of antenna elements could be used to allow a different number of radiation directivities.

Further, the metal tower 12 may be grounded since its resonance is substantially removed from the operating frequency of the antenna array whereby it does not significantly affect the radiated pattern. In the alternative, the tower 12 may be fabricated of an electrical insulator.

In summary, an improved directive antenna system has been described which is supported by a single structure and which allows a minimum of intercoupling cable between it and its control system. Further, the antenna array arrangement is such that the central supporting tower may be metallic and electrically grounded at its base portion.

While a preferred embodiment of the invention has been described in detail, it should be apparent that many modifications and variations thereto are possible, all of which fall within the true spirit and scope of the invention.

For example, it will be understood by anyone of ordinary skill in the art that the effective electrical length of the antenna elements may be varied in ways other than those disclosed. That is, the effective electrical length of an element may be decreased by coupling an inductive reactance thereto, and the electrical length increased by physically lengthening the element.

I claim:

1. A directive antenna system for radiating a signal in a selected direction comprising:

a vertically standing support means;

a plurality of antenna elements;

suspension means for suspending the elements from the support means in a predetermined spaced relationship such that each element is electrically insulated from the remaining elements and the support means;

selector means for selecting a desired radiating direction; and control means responsive to said selector means to:

(a) apply the signal to be radiated to a predetermined pair of said antenna elements and adjust the electrical length of said elements to optimally radiate said signal, (b) vary the electrical length of predetermined antenna elements to reflect said signal, and (c) vary the electrical length of predetermined antenna elements to direct said signal.

2. The antenna system of claim 1 wherein the vertically standing support means is comprised of a tower having an anchored base portion and a vertical extent tip portion.

3. The antenna system of claim 2 wherein the suspension means comprises means for affixing each antenna element to both the tip and base portion of the tower and means for otherwise guying each element away from said tower.

4. The antenna system of claim 3 wherein the suspension means is arranged to locate pairs of said antenna elements in a predetermined one of a plurality of vertical planes, said planes extending through the tower with each plane being spaced a predetermined horizontal angle from the remaining planes, and with each one of said antenna elements being on the opposite side of the tower from its coplanar antenna pair.

5. The antenna system of claim 4 wherein the suspension means is arranged to locate said vertical planes at equiangular spacings from one another.

6. The antenna system of claim 2 wherein the tower is fabricated of a conductive material, the system further comprising a means to ground said tower.

7. The antenna system of claim 1 wherein the control means comprises means to adjust the electrical length of the elements to which the signal is applied to be one half wavelength of said signal.

8. The antenna system of claim 7 wherein the control means further comprises means to vary the physical length of said directive elements to be less than one half wavelength of said signal.

9. The antenna system of claim 7 wherein the control means further comprises means to couple a predetermined value reactance to said reflective elements such that the electrical length of said elements exceeds one half wavelength of said signal.

10. A directive antenna system for radiating a signal in a selected direction comprising:

a vertically standing tower having an anchored base portion and a vertically extending tip portion;

a plurality of antenna elements, each element being comprised of a length of a conductor;

means for affixing the ends of each element to the tip, and the base portion, respectively, of the tower;

means for guying the central portion of each antenna element away from the tower such that antenna elements on opposite sides of the tower are coplanar in one of a plurality of vertical planes, which planes are equiangularly displaced from each other;

selector means for selecting a desired radiating direction; and control means responsive to said selector means to:

(a) apply the signal to be radiated to the coplanar antenna elements which are in a plane substantially perpendicular to the desired direction of radiation and to adjust the electrical length of said elements to optimally radiate said signal; and (b) vary the electrical length of the remaining antenna elements such that selective elements direct the radiation of said signal and selective elements reflect said signal.

11. The antenna system of claim 10 wherein the tower is fabricated of a conductive material, the system further comprising a means to ground said tower.

12. The antenna system of claim 10 wherein the control means comprises means to adjust the electrical length of the elements to which the signal is applied to be one half wavelength of said signal.

13. The antenna system of claim 12 wherein the control means further comprises means to vary the physical length of said directive elements to be less than one half wavelength of said signal.

14. The antenna system of claim 12 wherein the control means further comprises means to couple a predetermined value reactance to said reflective elements such that the electrical length of said elements exceeds one half wavelength of said signal.

* * * * *